US012233325B2

(12) United States Patent
Stewart

(10) Patent No.: US 12,233,325 B2
(45) Date of Patent: Feb. 25, 2025

(54) COURT EDGE ENHANCEMENT

(71) Applicant: Jacob Stewart, San Francisco, CA (US)

(72) Inventor: Jacob Stewart, San Francisco, CA (US)

( * ) Notice: Subject to any disclaimer, the term of this patent is extended or adjusted under 35 U.S.C. 154(b) by 0 days.

(21) Appl. No.: 16/814,640

(22) Filed: Mar. 10, 2020

(65) Prior Publication Data

US 2022/0016510 A1 Jan. 20, 2022

(51) Int. Cl.
*A63B 71/02* (2006.01)
*A63B 47/02* (2006.01)

(52) U.S. Cl.
CPC ..... *A63B 71/022* (2013.01); *A63B 47/02* (2013.01)

(58) Field of Classification Search
CPC ... A63C 2019/085; A63C 19/04; A63C 19/02; A63C 19/065; A63B 71/022; A63B 2102/02; A63B 69/38; A63B 47/02; A63B 47/021; A63B 71/0045; A63B 69/0097
See application file for complete search history.

(56) References Cited

U.S. PATENT DOCUMENTS 1,012,820 A * 12/1911 Cory ..... A63B 67/02 473/158
1,043,308 A * 11/1912 Everson ..... A63B 63/00 235/1 R
1,658,097 A * 2/1928 Pierce ..... A63B 69/0097 473/434
2,087,575 A * 7/1937 Littell ..... A63B 63/007 473/436
2,174,884 A * 10/1939 Kachel ..... A63B 67/04 473/434
2,280,376 A * 4/1942 Clark ..... A63B 47/025 473/462
2,486,723 A * 11/1949 Thompson ..... E04B 5/10 403/279
3,203,696 A * 8/1965 Sawyer ..... A63B 47/025 473/474

(Continued)

FOREIGN PATENT DOCUMENTS

CN 202920944 U * 5/2013
CN 203389292 U * 1/2014

(Continued)

OTHER PUBLICATIONS

CN 202920944 U (Year: 2013).*

(Continued)

*Primary Examiner* — Melba Bumgarner
*Assistant Examiner* — Amir A Klayman
(74) *Attorney, Agent, or Firm* — Booth Udall Fuller, PLC; Bryce W. Burnham

(57) ABSTRACT

An apparatus or system for enhancing an edge of a sporting court may include a first surface configured to engage with a surface of the sporting court and a second surface coupled to the first surface and configured to receive a ball and retain the ball in engagement with the second surface. The second surface may comprise a plurality of sub-surfaces, wherein one of the sub-surfaces may comprise a radial curve or at least one peak and at least one trough. The apparatus may comprise a retaining mechanism configured to retain at least one of the first surface or the second surface adjacent a court edge barrier.

6 Claims, 13 Drawing Sheets

(56) References Cited

U.S. PATENT DOCUMENTS 3,257,134 A * 6/1966 Boyd ..... B61D 17/10 403/279
3,687,457 A * 8/1972 Mason ..... A63B 63/00 473/166
3,690,674 A * 9/1972 Taylor ..... A63B 57/357 473/163
3,858,880 A * 1/1975 Graves ..... A63B 69/38 472/94
3,948,512 A * 4/1976 Worthington ..... E04H 3/10 473/459
3,966,205 A * 6/1976 Schain ..... A63B 63/00 473/462
3,986,719 A * 10/1976 Lee ..... A63B 63/00 473/197
3,989,245 A * 11/1976 Augustine, Jr. ..... A63B 47/025 124/53.5
4,004,806 A * 1/1977 Malik ..... A63B 69/40 473/460
4,108,432 A * 8/1978 Clark ..... A63B 47/025 124/53.5
4,191,374 A * 3/1980 Kulesza ..... A63B 65/12 124/78
4,203,413 A * 5/1980 Hodges ..... A63B 69/406 124/78
4,243,221 A * 1/1981 Ferreira-Godinho ..... A63B 61/006 473/432
4,336,939 A * 6/1982 Krumlauf ..... A63F 7/0005 473/192
4,362,422 A * 12/1982 Zinkann ..... E04C 2/428 403/387
4,422,632 A * 12/1983 Trottet ..... A63C 19/00 472/92
4,568,089 A * 2/1986 Jenkins ..... A63B 47/025 473/436
4,575,081 A * 3/1986 Cavanagh ..... A63B 47/025 473/460
4,606,543 A * 8/1986 Hartland ..... A63B 47/024 473/460
4,634,130 A * 1/1987 Simjian ..... A63B 57/357 473/153
4,789,286 A * 12/1988 Laput ..... F16B 7/044 248/296.1
4,875,678 A * 10/1989 Sawyer ..... A63B 47/025 473/475
4,919,421 A * 4/1990 Vandeveld ..... A63B 47/025 473/494
4,948,129 A * 8/1990 Bartasius ..... A63B 61/003 473/415
4,971,319 A * 11/1990 Cutrone ..... A63B 47/025 473/432
5,125,654 A * 6/1992 Bruno ..... A63B 47/024 473/460
5,141,226 A * 8/1992 Cavanagh ..... A63B 47/025 473/460
5,556,106 A * 9/1996 Jurcisin ..... A63B 63/00 273/395
6,179,722 B1 * 1/2001 Bond ..... A63B 69/3676 473/180
6,301,831 B1 * 10/2001 Cundy ..... E01F 13/105 404/15
6,834,776 B1 * 12/2004 Corvese ..... A63B 47/025 221/277
8,366,570 B1 * 2/2013 DeMarco ..... A63B 71/022 473/477
8,562,241 B2 * 10/2013 Klepack ..... F16B 37/046 403/262
8,663,036 B1 * 3/2014 Trieu ..... A63B 67/04 473/459
9,284,067 B2 * 3/2016 Shapira ..... E01F 9/571
9,469,945 B2 * 10/2016 Khurgin ..... A63B 47/025
9,592,429 B1 * 3/2017 Wolfe ..... A63B 61/00
9,623,314 B2 * 4/2017 Bray ..... A63B 71/022
10,806,990 B2 * 10/2020 Cho ..... A63C 19/02
10,811,857 B2 * 10/2020 Rouleau ..... F16M 13/02
2004/0038756 A1 * 2/2004 Brophy ..... A63B 69/38 473/451
2008/0292865 A1 * 11/2008 Ball ..... A63C 19/02 428/317.1
2009/0005196 A1 * 1/2009 Kessler ..... A63B 67/002 473/476
2009/0023523 A1 * 1/2009 Poillucci ..... A63B 63/00 473/478
2012/0322589 A1 * 12/2012 Harris ..... A63B 47/02 473/460
2015/0038247 A1 * 2/2015 Eltz, III ..... A63B 67/02 473/163
2017/0348582 A1 * 12/2017 Cho ..... A63B 69/40
2018/0237998 A1 * 8/2018 Vachon ..... A63C 19/02
2019/0083870 A1 * 3/2019 Kapsalis ..... A63B 69/002
2020/0009448 A1 * 1/2020 Cho ..... A63C 19/02
2020/0155912 A1 * 5/2020 Michaelson ..... A63B 69/002
2020/0301436 A1 * 9/2020 Sakai ..... G05D 1/0219
2021/0128989 A1 * 5/2021 Legg ..... G05D 1/0094

FOREIGN PATENT DOCUMENTS

EP 0122950 A1 * 10/1984
EP 0159275 A2 * 10/1985
EP 0310694 A1 * 4/1989
WO WO-8403448 A1 * 9/1984

OTHER PUBLICATIONS

CN 203389292 U (Year: 2014).*
EP 0122950 A1 (Year: 1984).*
EP 0159275 A2 (Year: 1985).*
EP 0310694 A1 (Year: 1989).*

* cited by examiner

COURT EDGE ENHANCEMENT

TECHNICAL FIELD

This disclosure relates generally to sporting facility improvements, and more specifically, to sporting court edge enhancements.

BACKGROUND

Sporting courts, such as indoor or outdoor courts for racket sports, often include fences at the court edge to, amongst other things, retain balls or other sporting implements within the sporting court. Construction techniques, improper drainage, and weather cause sporting courts to become degraded after time, and results in sporting courts that have rough edges, cracks, concrete separations, and other issues at the court edge. One significant problem sporting courts with gaps, cracks, and rough interfaces with fencing at the court edge create is that balls and other sporting implements may escape or become caught in the crack or gap at the court edge.

Prior inventors have attempted to overcome the issue with products such as a fence bumper band. The problem with these types of products is that they can still leave gaps, protruding ends, and these products do not adequately address the problem of gaps and cracks that arise from the movement and settlement of the sporting court or the fencing. Not only do gaps and cracks make a well-built sporting court appear to be poorly constructed or overly worn, gaps and cracks also cause balls to get stuck in the space between the fence and the sporting court, which makes collecting balls inconvenient, difficult, and a timely process.

Players may use larger quantities of balls during a practice or instruction than he or she will use while playing a match. At some time during a practice or instruction, the player will need to collect the balls he or she has used. A player may gather balls by hand or he or she may utilize one of several types of ball collecting machines that exist to speed up the ball collection process. Machines that collect balls on sporting courts are commonly referred to as a "ball mower". Depending on the type, a ball mower may be manually operated or automatically operated by a player. For a ball mower to collect balls, the ball mower must be able to reach the balls. Because, however, the left and right arms of these machines are unable to fit in the space between the ball and the fence line, these ball mowers are unable to collect balls that came to rest along the fence line. Nevertheless, people drive a ball mower against the fence, hoping the balls pop off the fence in a manner in which the ball mower can pick them up. This, though, is problematic because such action can lead to premature damage to the fence and hasten the time until a repair is necessary. The only current alternative for a ball mower to collect balls near the fence line is for a player to push away balls, one by one, from the fence line before using the ball mower to collect the balls. This method is obviously inefficient causing the player to expend additional time collecting balls rather than receiving additional instruction and training.

In addition to the time wasted, balls stuck in gaps and cracks along the fence line result in additional costs to players and sporting clubs. You see, balls that become stuck in a gap or crack are often overlooked during ball collection. This causes a reduction in the total balls a player and sporting club have to use at any given time, which results in players and sporting clubs purchasing additional balls.

BRIEF DESCRIPTION

The following drawings form part of the present specification and are included to further demonstrate certain aspects of the present invention. The invention may be better understood by reference to one or more of these drawings in combination with the detailed description of specific embodiments presented herein.

Figure 9:
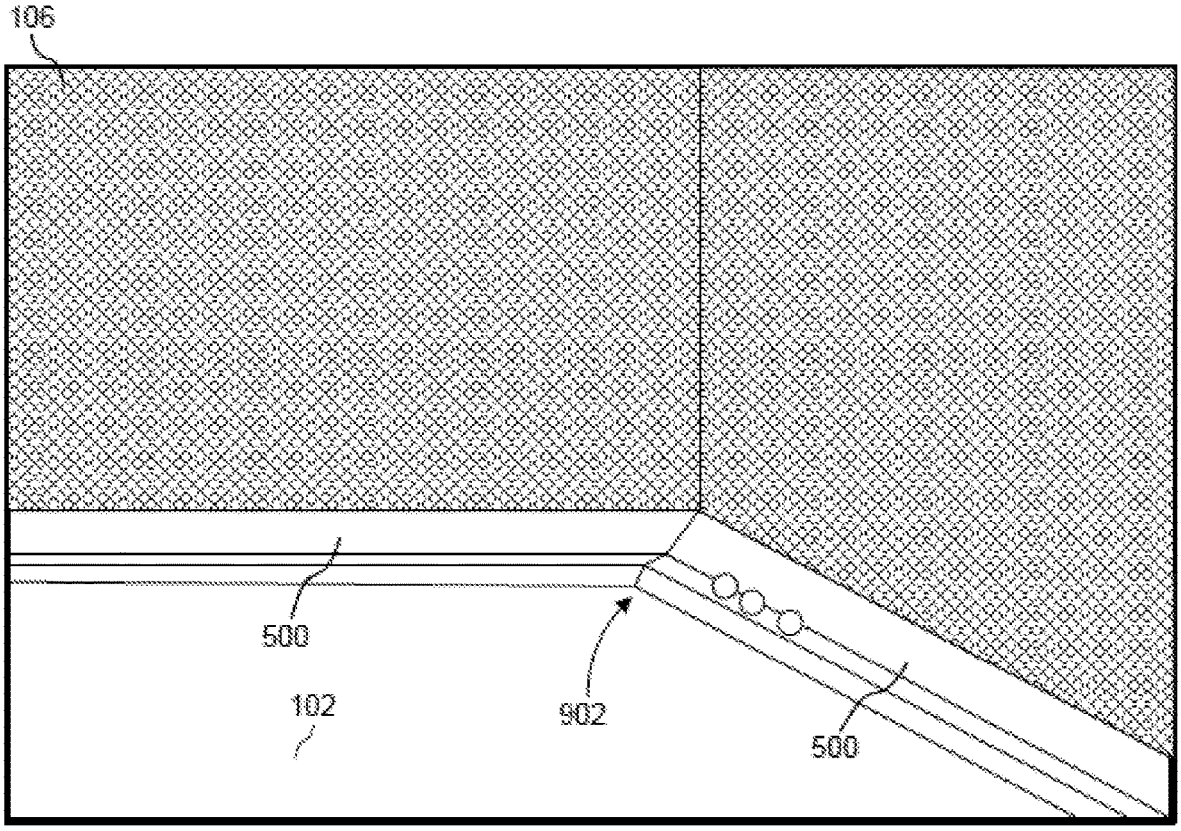

FIG. 9. is a perspective view illustration of a junction of two segments of an embodiment of a court edge enhancement.

Figure 10:
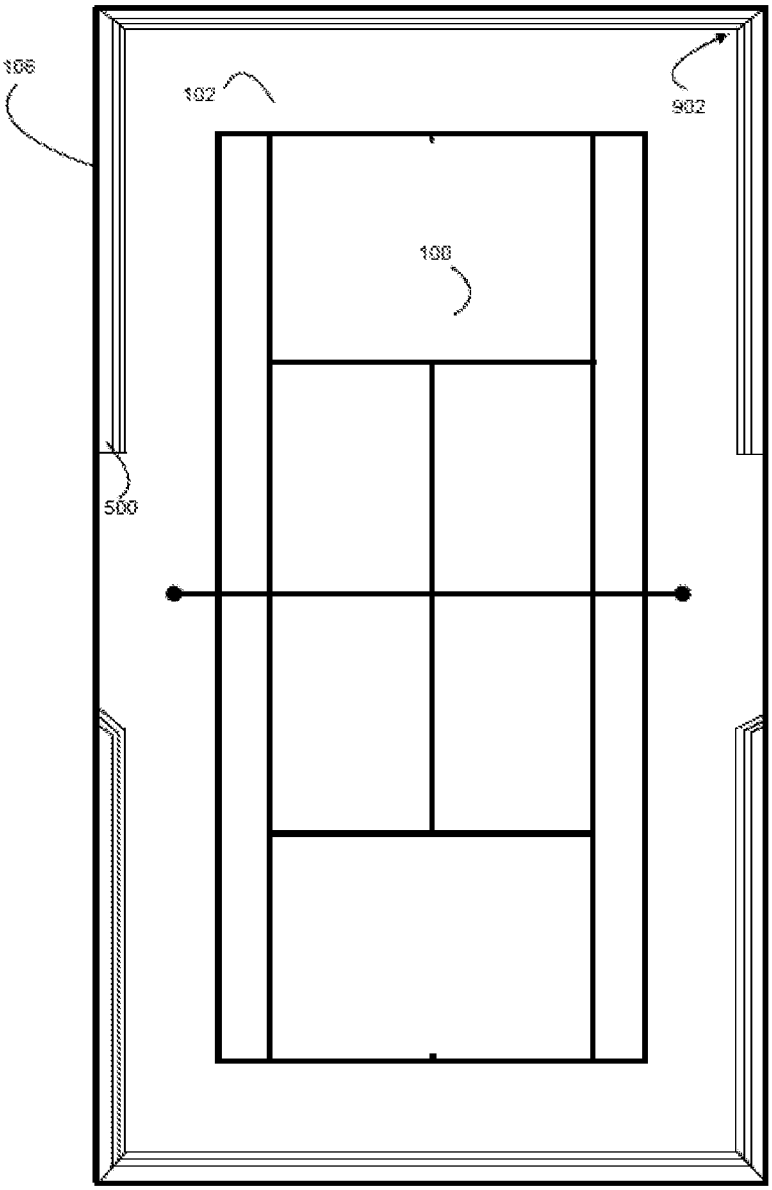

FIG. 10 is a top view illustrating several segments of an embodiment of a court edge enhancement.

Figure 11A:
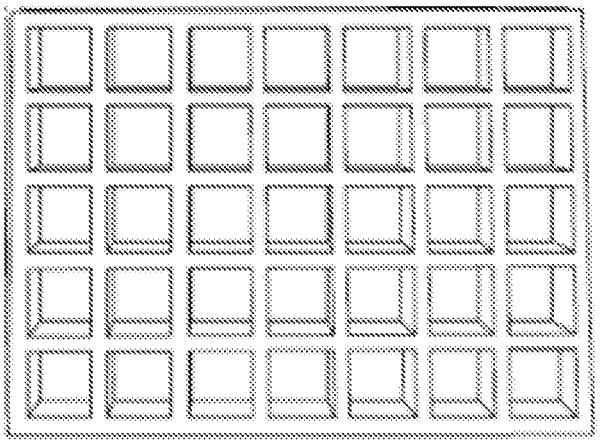

FIG. 11*a* is an illustration of one embodiment of a construction configuration for a court edge enhancement.

Figure 11B:
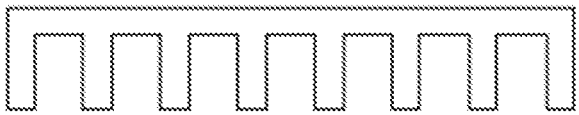

FIG. 11*b* is an illustration of one embodiment of a construction configuration for a court edge enhancement.

Figure 12:
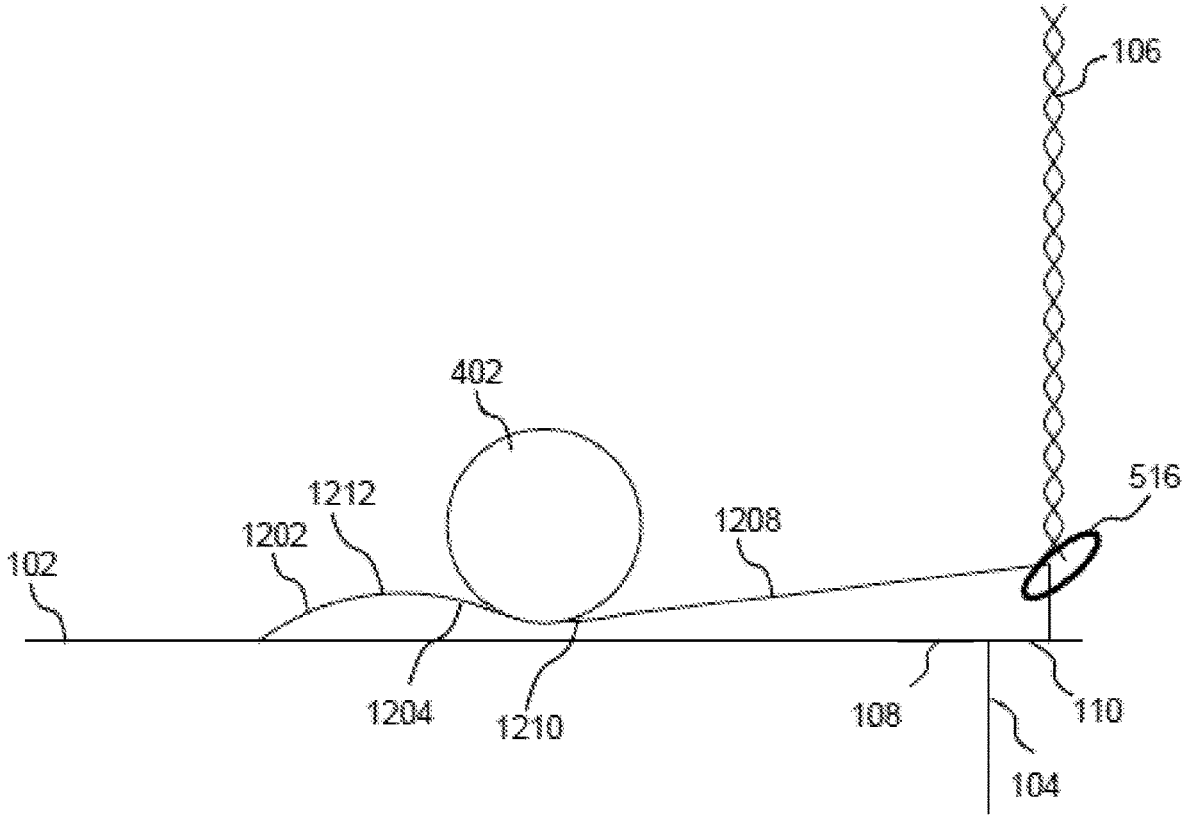

FIG. 12 is an illustration of one embodiment of a construction configuration for a court edge enhancement.

Figure 13:
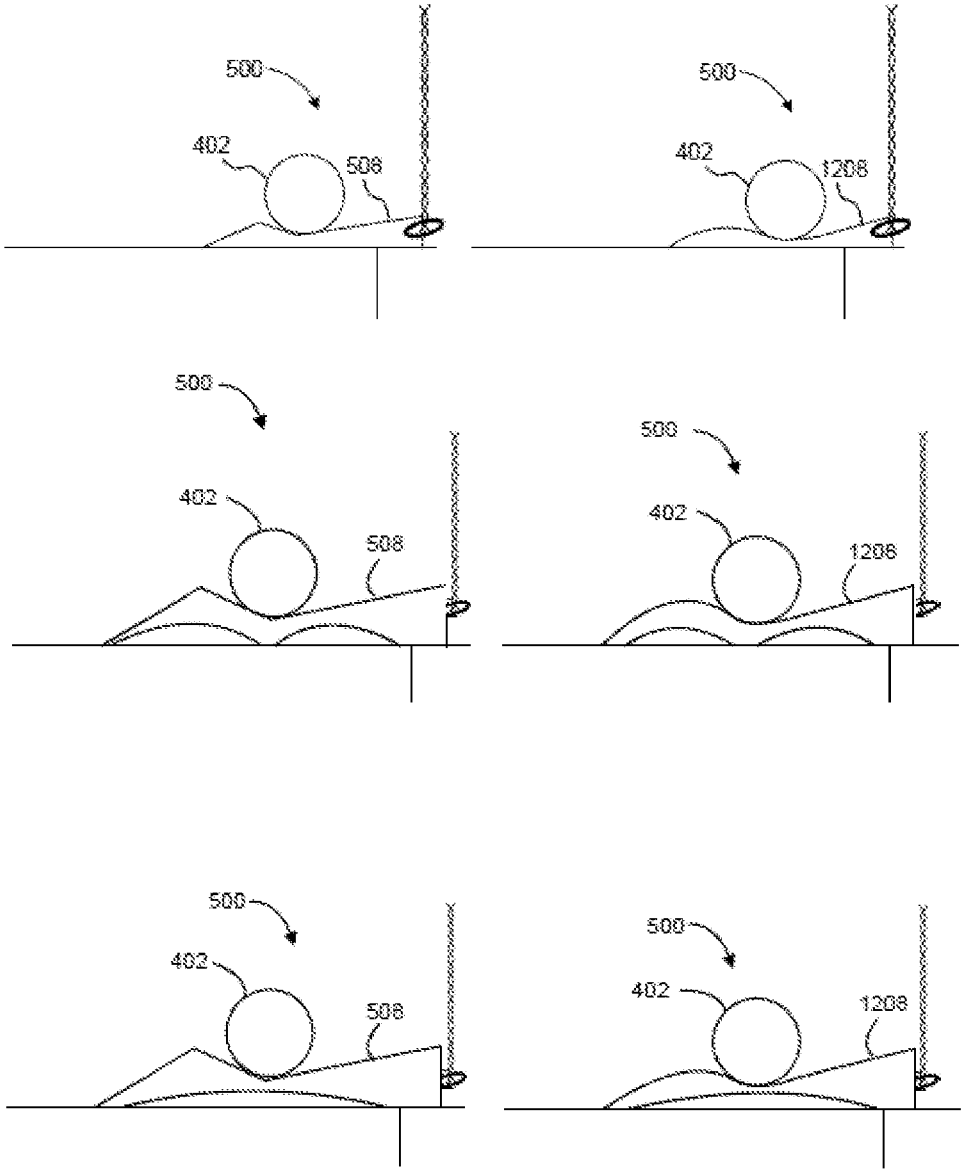

FIG. 13 is a dimensioned side view of multiple embodiments of a court edge enhancement.

Figure 14:
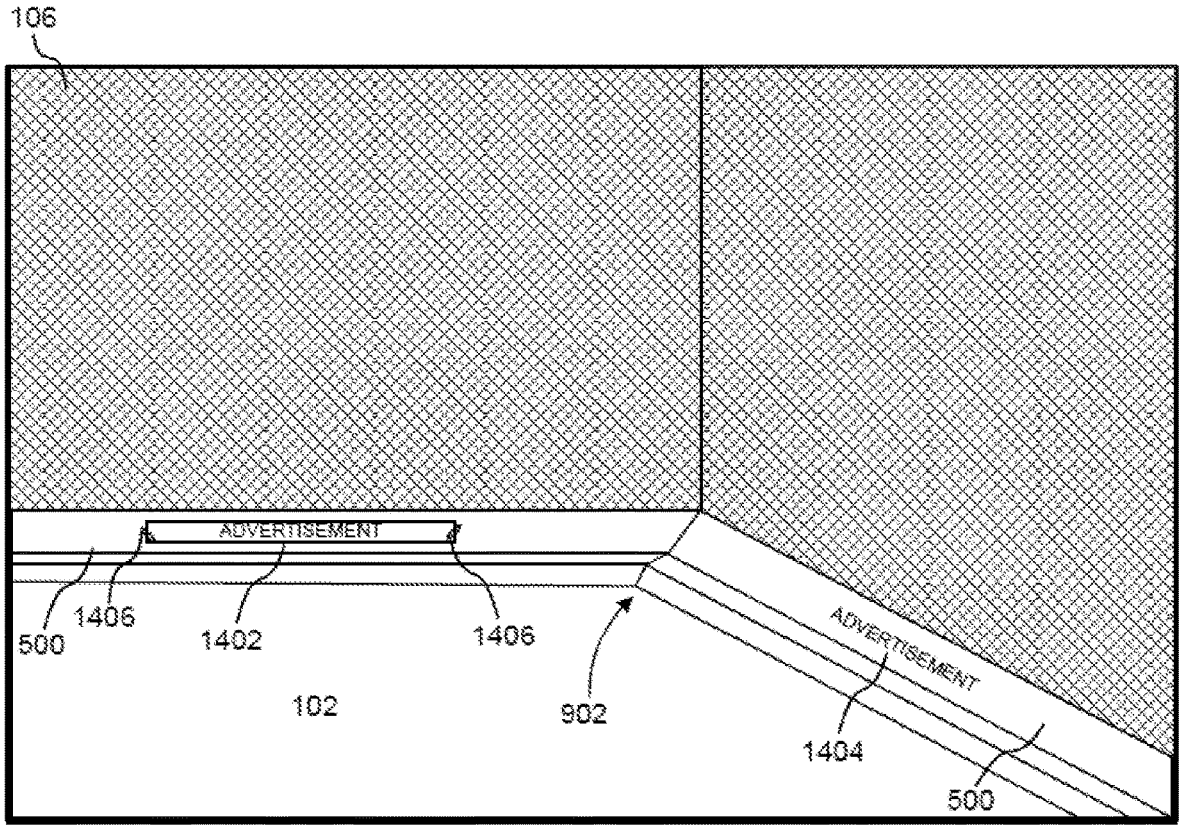

FIG. 14 is a perspective view illustration of a junction of two segments of an embodiment of a court edge enhancement.

DETAILED DESCRIPTION

Figure 1:
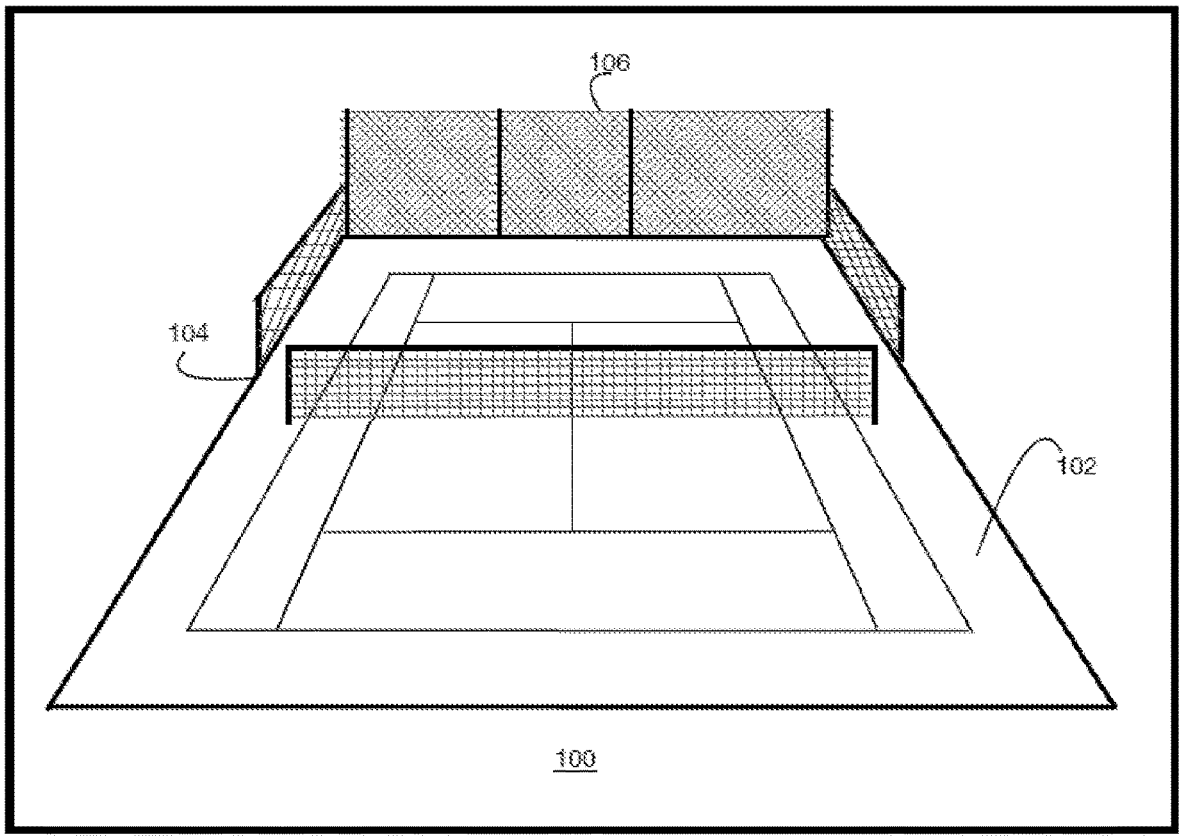
FIG. 1 (PRIOR ART)
FIG. 1 is an illustration of a tennis court according to the prior art.

Referring first to FIG. 1, a sporting court 100 like those used for tennis are generally rectangular in shape and have a surface area 102 typically constructed of a hard material such as a concrete or concrete-based material. A fence 106, often made of a suitable woven wire, usually surrounds a portion or the entire perimeter of the sporting court 100. Fencing 106 may also be present on at least one portion of the sporting court 100 to separate a first sporting court 100, or a portion thereof, from a second sporting court 100. Fencing 100 height and length may vary based on several factors including intended use, need, and design.

Figure 2:
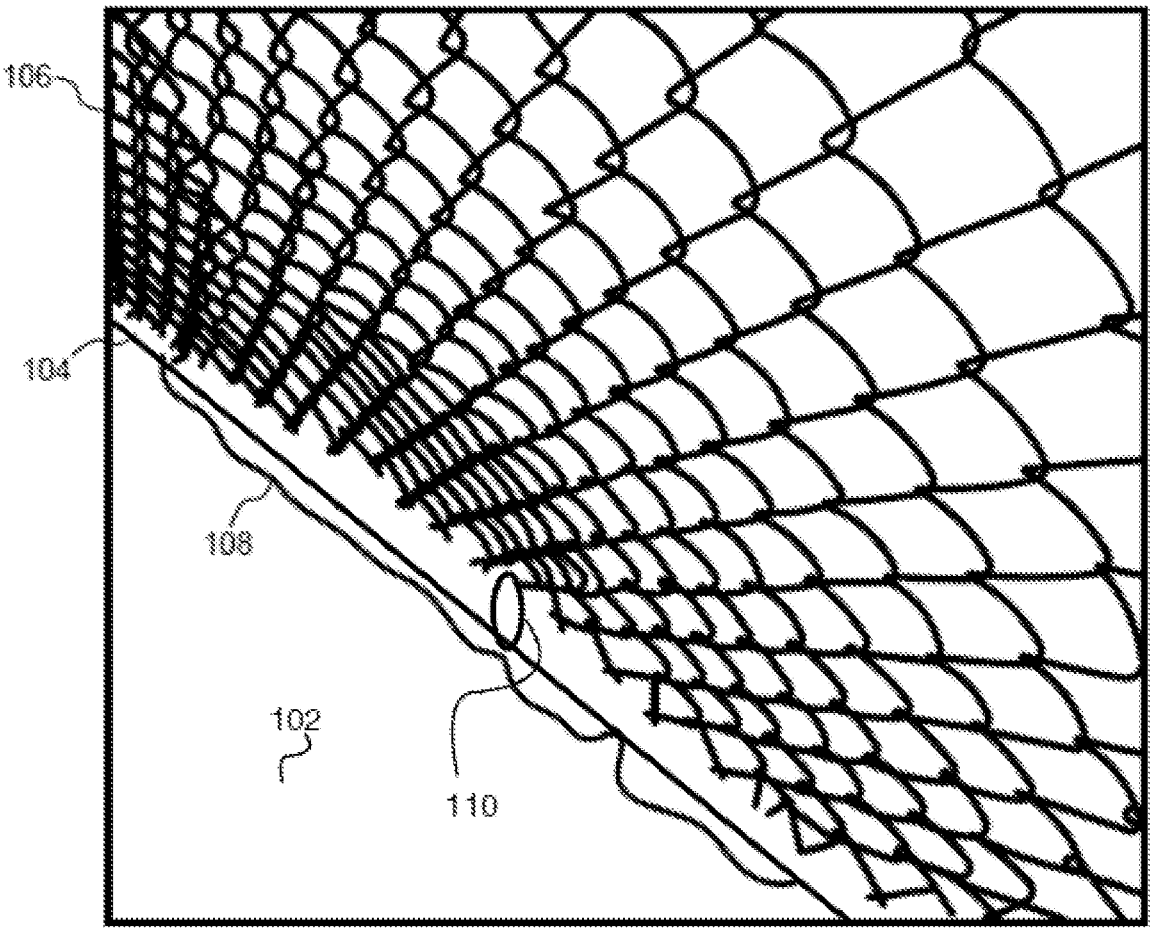
FIG. 2 (PRIOR ART)
FIG. 2 is an illustration of a tennis court edge according to the prior art.

As illustrated in FIG. 2, a fence 106 is typically positioned just outside the perimeter of the sporting court 100 with the bottom most portion of the fence 106 ending near the surface 102 and surface edge 104 of the sporting court 100. Over time, and because of construction methods used, weather, and improper drainage, cracks 108 in the sporting court's 100 surface 102 and gaps 110 between the fence 106 and the sporting court's 100 surface edge 104 will develop.

Figure 4:
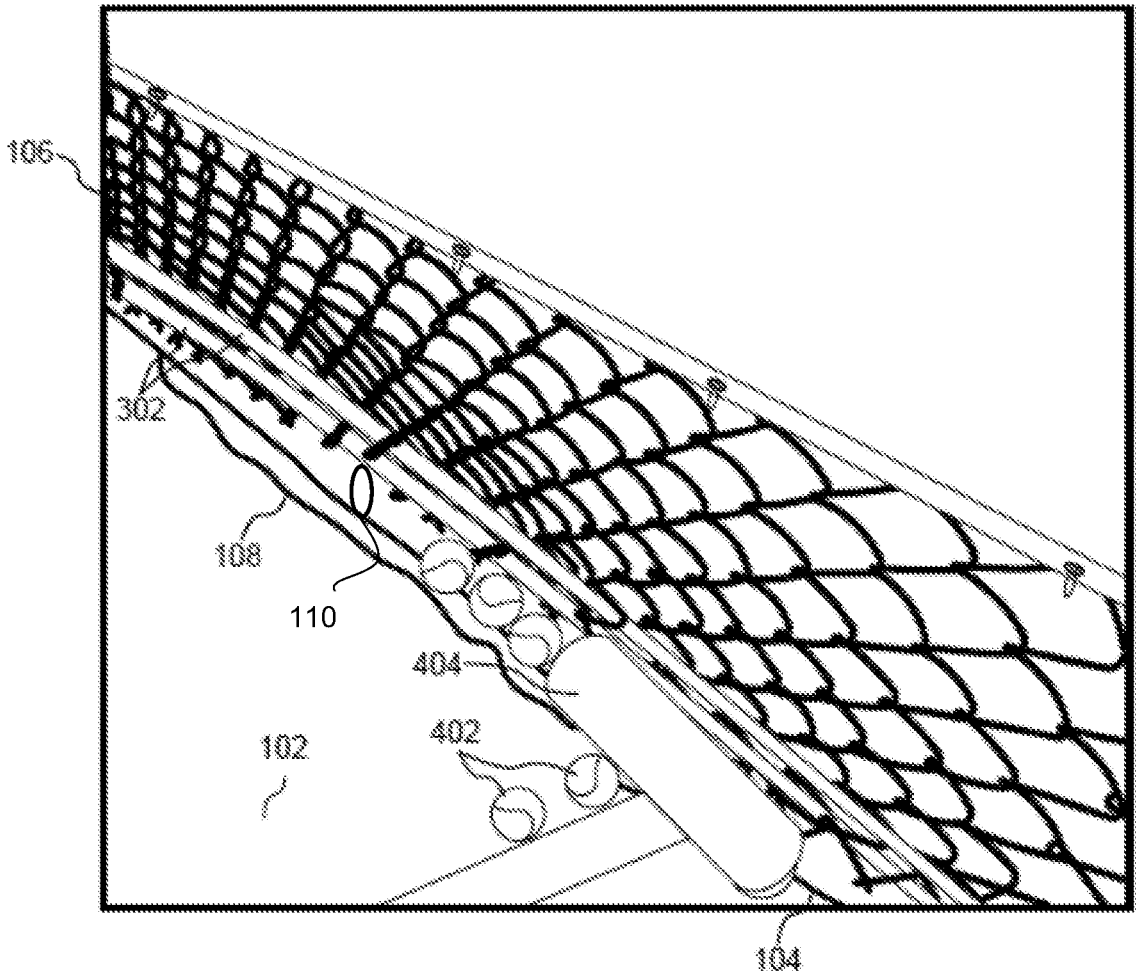
FIG. 4 (PRIOR ART)
FIG. 4 is an illustration of a ball mower according to the prior art.

As illustrated in FIG. 4, balls 402 may roll or otherwise come to rest on a crack 108 on the sporting court 100 surface 102 or within a gap 110. This is problematic to players and sporting clubs alike, because this results in amongst other things, increased time retrieving balls, increased costs to replace overlooked, missing, and lost balls, as well as damage to a sporting court 100, fencing 106, or ball mower 404 from improper retrieval or collecting of balls 106 located in cracks 108 and gaps 110.

To retrieve balls from most areas of a sporting court 100, players can use his or her hands or a ball mower. Current iterations of a ball mower 404 incorporate a set of extensions, commonly referred to as "arms", for gathering balls 402 and funneling the balls 402 toward an opening at the base of the ball mower 404 where the balls 402 are collected. Players can easily navigate a ball mower 404 around open areas of a sporting court 100; A crack 108 or gap 110 presents certain problems for retrieving balls with a ball mower 404. To operate a ball mower 404 in a crack 108 or gap 110, the arm of the ball mower 404 must be pressed firmly against the fence 106, which risks causing damage to the fence 106 to effectively retrieve balls 402. Moreover, a gap 110 of sufficient width for a ball 402 to become stuck or otherwise retained in makes it simply impossible for the arm of the ball mower 404 to come into contact the balls 402 to retrieve balls 402 retained in the gap 110.

Figure 3:
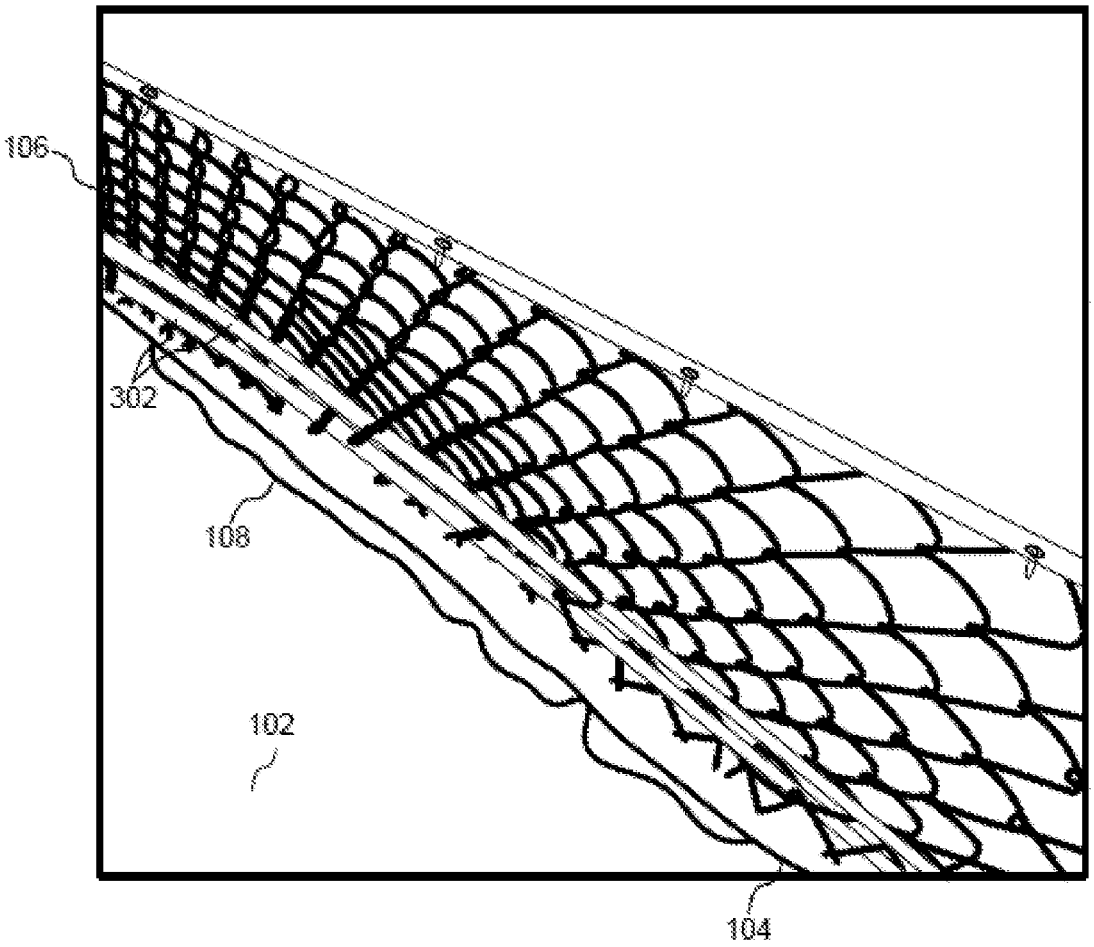
FIG. 3 (PRIOR ART)
FIG. 3 is an illustration of fencing bumper bands according to the prior art.

Prior art such as the fence bumper band 302 shown in FIG. 3, attempts to prevent balls 402 from becoming lodged or retained in a gap 110 or crack 108 by ricocheting or bouncing the ball 402 off the fence 106 and away from the gap 110 or crack 108 so the ball 402 cannot come to rest in a crack 108 or a gap 110. Prior art fails to solve the present problem for several reasons including, but not limited to, the prior art requires a ball 402 to not only come into contact with the fence bumper band 302 but also requires the ball 402 contact the fence bumper band 302 with force sufficient to ricochet or otherwise propel the ball 402 away from the fence 106, a crack 108 or a gap 110. If a ball 402 does not contact the fence bumper band 302 or if a ball 402 does contact the fence bumper band 302, but such contact is insufficient to propel the ball 402 a distant sufficient to avoid the crack 108 or gap 110, a ball 402 will likely become lodged in a crack 108 or a gap 110, and a player will be unable to efficiently retrieve the ball 402 using a ball mower 404.

Figure 5:
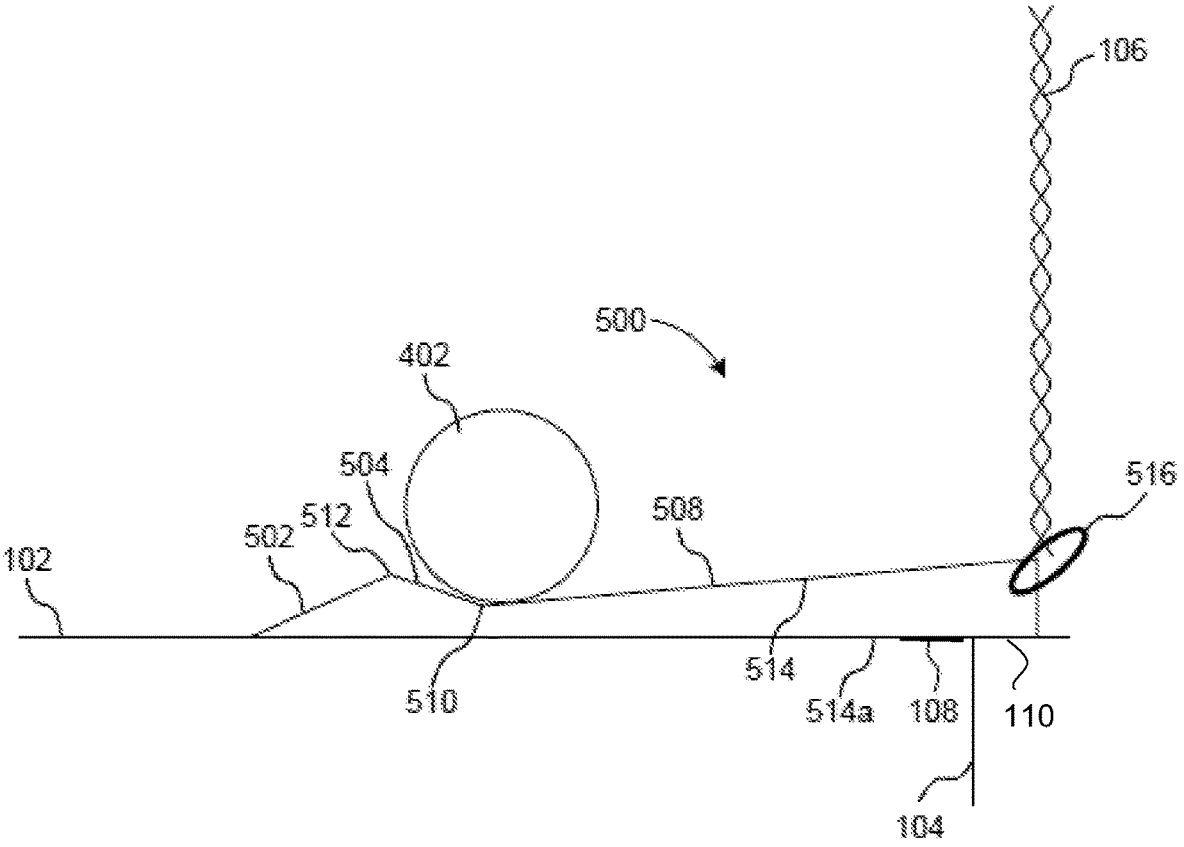
FIG. 5 is a side view illustration of one embodiment of a court edge enhancement.

FIG. 5 shows a side view of one embodiment of the present invention, a court enhancement apparatus 500 and components thereof. A court enhancement apparatus 500 may be configured to, at least partially, rest on the sporting court 100 surface 102. Additionally, the court enhancement apparatus 500 may be configured to interface, at least in part, with a fence 106. Alternatively, a court enhancement apparatus 500 may be configured to rest entirely on a sporting court 100 surface 102 without a fence 106 interface. In such embodiments, a court enhancement apparatus 500 comprises a first surface 514*a* which may be configured to engage a surface 102 of a sporting court 100 to effectively cover a crack 108, a gap 110, or any other divergences of the sporting court 100 surface 102 at or near a surface edge 104 and a fence 106 and a second surface 514 coupled to the first surface 514*a* and configured to receive a ball 402 and retain the ball 402 in engagement with the second surface 514. The second surface 514 consists of a compound surface comprising a plurality of sub-surfaces 508, 504, 502 that are disposed at alternative angles relative to the adjacent sub-surfaces.

As further illustrated in FIG. 5, the second surface 514 may have a plurality of sub-surfaces 508, 504, 502 wherein one or more of the sub-surfaces may be planar. The second surface 514 may contain: a first ramped surface 508 disposed at a first angle with respect to the sporting court 100 surface 102; a second ramped surface 504 disposed at a second angle with respect to the sporting court 100 surface 102; and a third ramped surface 502 disposed at a third angle with respect to the sporting court 100 surface 102. The plurality of sub-surfaces 508, 504, 502 forming at least at peak 512 and at least one trough 510, configured to receive a ball 402 and retain the ball 402 in engagement with at least one sub-surface 508, 504.

Alternatively, as shown in a side view of one embodiment of a court enhancement apparatus 500, the second surface 514 may have a plurality of sub-surfaces 1108, 1104, 1102, wherein one or more of the sub-surfaces 1108, 1104, 1102 may be curved according to a parabolic, hyperbolic, elliptical, or circular function. For instance, a first ramped surface 1108 disposed at a first angle with respect to the sporting court 100 surface 102 and a second ramped surface 1104 disposed at a second angle with respect to the sporting court 100 surface 102 may be configured in such a manner to form at least one curved trough 1110. And a third ramped surface 1102 disposed at a third angle with respect to the sporting court 100 surface 102 and a second ramped surface 1104 disposed at a second angle with respect to the sporting court 100 surface 102 such that the third ramped surface 1102 and the second ramped surface 1104 are configured in such a manner to form at least one curved peak 1112. The curved peak 1112 and curved trough 1110 configured to receive a ball 402 and retain the ball 402 in engagement with at least one sub-surface 1108, 1104.

The court edge enhancement apparatus 500 in its various embodiments may reduce balls 402 from returning into the sporting court 100 during play, practice, or instruction, as well as may reduce the time and effort needed to gather balls 402 by ensuring a ball mower 404 can reach all of them. The present invention achieves this by the ball 402, after hitting the fence 106 and traveling to the first ramped surface 508, 1108 where the ball 402 will roll away from the fence 106 toward the toward the trough 510, 1110 and the second ramped surface 504, 1104. The second ramped surface 504, 1104 contains a peak 512, 1112 where the second ramped surface 504, 1104 and a third ramped surface 502, 1102 intersect. The second ramped surface 504, 1104 further slows the ball 402 and the peak 512, 1112 prevents the ball 402 from re-entering the sporting court 100. The ball 402 will remain at the trough 510, 1110 until the ball 402 is collected. The distance between the fence 106 and the trough 510, 1110 where the ball 402 is retained is sufficient to permit a ball mower 404 arm to travel between the fence 106 and the trough 510, 1110 and retrieve the balls 402. Even if many balls 404 are located on the court enhancement apparatus 500, the ball mower 404 can be pushed multiple times to gather all balls 402 from the court enhancement apparatus 500, 1100 without coming into contact with the fence 106. In addition, the slopes and distances of the several embodiments will work both with traditional tennis balls and the slightly larger, lower compression balls being used to teach today's youth.

Figure 6:
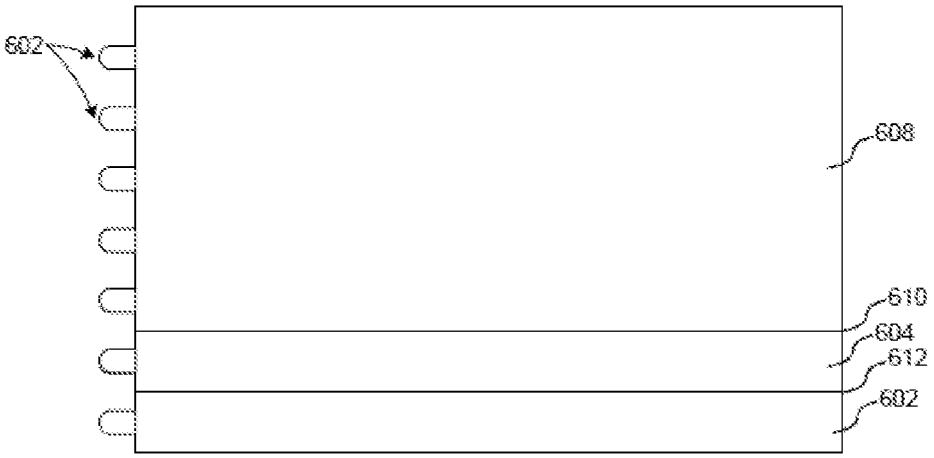
FIG. 6 is a top view of one embodiment of a court edge enhancement.
Figure 7:
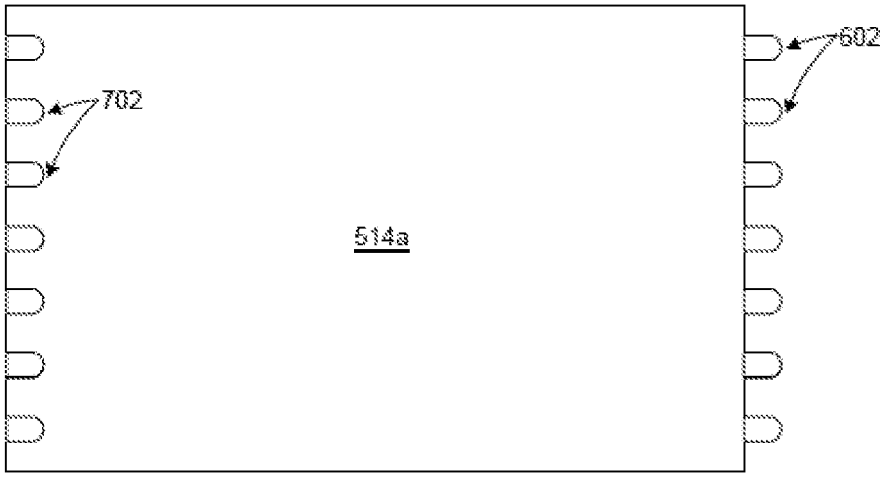
FIG. 7 is a bottom view of one embodiment of a court edge enhancement.

Turning next to FIGS. 6-7, a court enhancement apparatus 500 may be manufactured in segments, with one segment of the court enhancement apparatus 500 able to be connected, joined, or otherwise connected to at least one other court enhancement apparatus 500. A segment could range in length from one inch to one hundred and twenty feet, though shorter segments may be preferred, such as segments ranging from one foot to five feet, for purposes of shipping conveniences. Segments of different shapes and sizes (separately and collectively), including, but not limited to, lateral pieces, for the common straight runs along the sides and back of a sporting court 100, corner pieces, to connect the lateral pieces together at 90° angles, California corner pieces, to connect lateral pieces together at 45° angles to accommodate courts that have California corners, U Turn pieces, which are shaped to accommodate a U turn around a mid-height fence, such as those that often separate two adjacent courts, transition pieces, for transitioning from the full version to a narrower embodiment, door pieces: of same material to provide additional depth on a fence door so that balls are not lost underneath it, and customizable lateral pieces, so that when width or length has been adjusted for surroundings instead of built to exact spec, the rest of the pieces can still provide a fit may be manufactured or cut by an installer for each section of a sporting court 100.

As shown in FIG. 6, a court enhancement apparatus 500 may include at least one protrusion 602 on one or more portions of the court enhancement apparatus 500. Each court enhancement apparatus 500 will have at least one "receptacle" 702, as illustrated in FIG. 7, that corresponds in shape and position to the protrusion on the a court enhancement apparatus 500 to which a segment is to be joint. A protrusion 602 of one segment may be inserted, snapped, joined or otherwise combined into the corresponding receptacle 702 of one or more other court enhancement apparatus 500 for securing a plurality of segments of the court enhancement apparatus 500 together, thereby forming a contiguous length of court enhancement apparatus 500, and thereby allowing customization of the court enhancement apparatus 500 to fit various court configurations and sizes.

Figure 8:
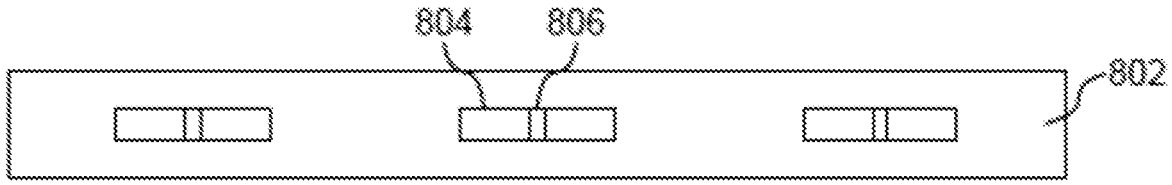
FIG. 8 is a back view of one embodiment of a court edge enhancement.

FIG. 8 illustrates a back view of the court enhancement apparatus 500, which includes fence interface member 802. In various embodiments, the fence interface member 802 may include one or more loops, slots, or holes, hooks, protrusions, or the like for securing the court enhancement apparatus 500 to the fencing 106 with a fixation device 516, such as a zip tie, cord, rope, fastener, clamp, or the like. For example, many alternative methods may be used to secure the court enhancement apparatus 500, including a tie-back method in which an installer clicks tile pieces together along fence line. Additionally, an installer may use zip ties or strong cord to secure tile pieces to the fencing 106 to avoid movement. This is desirable for speed and stabilization so segments do not move and the ability to refine, re-secure, or re-adjust quickly and easily as needed in the future. Moreover, because the life expectance of the invention is expected to exceed the life expectancy of the sporting court 100 surface 102, the court enhancement apparatus 500 segment or segments could be unclipped and removed or temporarily lifted during the resurfacing of a sporting court 100, after which the court enhancement apparatus 500 segment or segments could then be repositioned.

In an alternative fixation method called the "floating method", the court enhancement apparatus 500 may secured to the sporting court 100 by simply clicking segments of the court enhancement apparatus 500 together along fence line and leave the segment or segments floating on sporting court 100 surface 102 with respect to the fencing 106. This method would rely on weight to hold the court enhancement apparatus 500 in place. This installation method would be fastest, but the potential movement of the segment or segments of the court enhancement apparatus 500 on the sporting court 100 could present a hazard to player safety.

Another alternative installation method could include a glue down method, in which the installer clicks segments of the court enhancement apparatus 500 together along fence line, then an adhesive is applied to the underside of the court enhancement apparatus 500 to secure the court enhancement apparatus 500 segment or segments to the sporting court 100 surface 102. This method might be best for new sporting court 100 construction, but it is likely not preferable to other options, since it would require more involved removal if or when the sporting court 100 needs resurfacing.

Yet another alternative installation method could include a form poured method, in which the court enhancement apparatus 500 is poured into a form at the surface edge 104 of the sporting court 100 surface 102. This might be best used for new court construction.

As illustrated in FIG. 9, the court enhancement apparatus 500 may be cut or manufactured with various mitered edge angles 902 for allowing joints at angled surfaces of the fence 106, such as corners and the like. Additionally, finishing end-caps, such as those seen in FIG. 10, and the like may be furnished for defining a clean and professional looking end or edge to the court enhancement apparatus 500, for example, doorways or walkways or other pass-throughs.

FIG. 11*a* illustrates one embodiment of a configuration that provides a breathable and drainable mesh or porous surface. Such an embodiment may allow drainage and evaporation of rain water, irrigation water, and the like. Additionally, as shown in FIG. 11*b*, a portion or all of the court enhancement apparatus 500 may include channels or pilings to elevate the court enhancement apparatus 500 above the surface 102 of the sporting court 100 to allow water to drain through the court enhancement apparatus 500 and off of the sporting court 100.

It should be noted that the dimensions of one embodiment of the court enhancement apparatus 500 seen in FIGS. 5-14 or otherwise articulated herein are described for illustrative purposes, one of ordinary skill will recognize that a variety of dimension ranges and angle ranges, and configurations may be used without deviation from the scope and content of the present embodiments. Indeed, one of ordinary skill will recognize many equivalent configurations, materials, and dimensions that may be suitable for use according to the described methods. Indeed, many different materials may be suitable for the present embodiments. In various embodiments, the materials may be comprised of various plastics: including polypropylenes (such as co-polymers, homopolymers or impact), elastomeric thermoplastic polyurethanes of various kinds, Polyolefin, ethylene styrene interpolymer or any of the styrene acrylic copolymers, aliphatic polymers, and other plastics. Alternatively, the court enhancement apparatus 500 may be constructed of woods of various kinds, including (but not limited) to bamboo. In other embodiments, the court enhancement apparatus 500 may be constructed of metals, rubber based materials such as "poured rubber", "soft rubber", NBR (nitrile Butadiene), SBR (styrene butadiene), CR (chloroprene), silicone, fluorocarbon, acrylamide, epichlorohydrin, and/or carboxylated natural and synthetic latexes, cork, porous concrete, or asphalt and the like. The court enhancement apparatus 500 may also be constructed of vinyl or an acrylic material. In addition, the court enhancement apparatus 500 may be constructed of quartz or laminate.

Likewise, in one embodiment, a material that is fungus and mildew resistant and dries very quickly may be used. This is because the court enhancement apparatus 500 will rest on or on top of the sporting court 100 surface 102 and standing water will accelerate surface cracking. Cracking along the edges and/or under the invention would not be detrimental to the function of the invention or the playability of a sporting court 100, but proper precautions should still be taken.

FIG. 13 illustrates multiple embodiments configured to be a trim that is not designed to accommodate ball mowers 404, but is designed to clean up the appearance, reduce balls 402 lost to gaps 110 and hold balls 402 on surface edge 104 rather than let balls 402 roll onto the sporting court 100. This can also be used by players when they want to roll balls 402 to rest along the fence 106, a typical tennis motion when somebody wants to have two balls as they serve, and desire a third to rest along the fence 106. This embodiment could utilize a peak 512, 1102 or may simply provide a single ramped surface. Although each of the embodiments described herein include an angle of the ramped surface with respect to the court that is smaller than the angle with respect to the fence 106, one of ordinary skill will recognize that in various embodiments, the angles may be different. For example, the angle of the ramped surface (or surfaces) of the court enhancement apparatus 500 may be greater than and/or equal to the angle of the sporting court's 100 surface 102, with respect to the fence 106 located about the outer area of court.

In addition to solving the above-mentioned problems, the described embodiments may also provide an excellent marketing opportunity. As illustrated in FIG. 14, a company logo or an advertisement 1404 could be imprinted, engraved, printed, stamped, embossed, emblazoned, etched, carved, impressed, or otherwise placed or fixed on each segment of court enhancement apparatus 500. Alternatively, a logo holder 1402 may be incorporated for attaching a removable logo 1406. This would be seen nearly every time an individual bends over to pick up a ball 402 or every time they look down as they drive the ball mower 404 around. This could be beneficial for equipment companies, apparel companies or other companies trying to market to the player demographic.

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A sporting court system comprising:

(A) a passive apparatus without moving parts for ball collection comprising a repeating plurality of joined segments for enhancing an edge of the sporting court, each of the joined segments comprising:

a first surface configured to intermittently engage with a surface of the sporting court, the first surface comprising breathable and drainable mesh;

a second surface disposed over the first surface and coupled to the first surface wherein the second surface is configured to receive a ball and retain the ball in engagement with the second surface;

a third surface that extends vertically between the first surface and the second surface, the third surface being configured to couple with a fence at an edge of the sport court;

wherein the second surface further comprises a plurality of at least three sub-surfaces or portions comprising a first ramped surface, a second ramped surface, and a third ramped surface, wherein the second surface further comprises:

the first ramped surface beginning opposite the third surface that increases in height towards the third surface, the second ramped surface coupled with the first ramped surface that decreases in height towards the third surface, the third ramped surface coupled with the second ramped surface that increases in height towards the third surface, the third ramped surface being longer than the second ramped surface, and the second ramped surface and the third ramped surface forming a trough configured to receive and retain the ball;

wherein each segment of the plurality of joined segments comprises a protrusion on a first side and a receptacle on a second side opposite the first side, the protrusion configured to be inserted in the receptacle of an adjacent joined segment and the receptacle configured to receive the protrusion of an adjacent joined segment;

(B) the passive apparatus without moving parts comprising a contiguous length formed by each of the joined segments coupled together with the protrusion of the segment inserted in the receptacle of the adjacent joined segment; and (C) a ball mower that passes over the contiguous length of the passive apparatus without moving parts to collect a plurality of balls that are stationary and disposed on the second surface of the contiguous length, wherein the ball mower passes the plurality of balls engaged with the second surface away from the contiguous length of the passive apparatus into the ball mower.

2. The sporting court system of claim 1, wherein at least one of the plurality of sub-surfaces is curved.

3. The sporting court system of claim 1, wherein the plurality of sub-surfaces form at least one peak and at least one trough.

4. The sporting court system of claim 1, further comprising a plurality of mated corner segments for coupling a plurality of segments at an angle.

5. The sporting court system of claim 1, wherein the second surface is configured to receive a graphic.

6. The sporting court system of claim 1, further comprising a fence interface member for securing the apparatus to the fence with a fixation device.

* * * * *